US007819783B2

(12) United States Patent
St. George et al.

(10) Patent No.: US 7,819,783 B2
(45) **Date of Patent: *Oct. 26, 2010**

(54) SKIPPING ROPE HAVING IMPROVED HANDLE

(76) Inventors: David St. George, 86 Duke of York Square, London, UK (GB) SW3 4LY; Clayton O'Shea, 72 Westacott Close, London, UK (GB) N19 3LF ( * ) Notice: Subject to any disclaimer, the term of this patent is extended or adjusted under 35 U.S.C. 154(b) by 82 days.

This patent is subject to a terminal disclaimer.

(21) Appl. No.: 11/737,615

(22) Filed: Apr. 19, 2007

(65) Prior Publication Data

US 2007/0191195 A1 Aug. 16, 2007

Related U.S. Application Data

(63) Continuation of application No. 10/673,936, filed on Sep. 29, 2003, now Pat. No. 7,341,544, which is a continuation-in-part of application No. 10/409,687, filed on Apr. 7, 2003, now Pat. No. 7,223,211, which is a continuation of application No. 09/774,376, filed on Jan. 31, 2001, now Pat. No. 6,544,149.

(30) Foreign Application Priority Data

Feb. 1, 2000 (GB) ..... 0002337.4

(51) Int. Cl.
*A63B 5/20* (2006.01)

(52) U.S. Cl. ..... 482/81; 482/82

(58) Field of Classification Search ..... 16/110.1, 16/428, 430, 437, 442, 224, 441; 123/185.2; 482/82, 81

See application file for complete search history.

(56) References Cited

U.S. PATENT DOCUMENTS

| | | | | | |
|---|---|---|---|---|---|
| 1,436,703 | A | * | 11/1922 | Fisher | 482/82 |
| 3,572,307 | A | * | 3/1971 | Harkness et al. | 123/185.2 |
| 4,293,125 | A | * | 10/1981 | Hinds | 482/82 |
| 4,850,233 | A | * | 7/1989 | Ishigo | 74/6 |
| 5,153,967 | A | * | 10/1992 | Zimmermann et al. | 16/442 |
| 5,681,248 | A | * | 10/1997 | Vani | 482/126 |

* cited by examiner

*Primary Examiner*—Jerome Donnelly
(74) *Attorney, Agent, or Firm*—Buckley, Maschoff & Talwalkar LLC

(57) ABSTRACT

Conventional skipping ropes have a generally elongate handle swivellably mounted on each end of the rope which is held by the user between the fingers and palms. In accordance with the invention, the handle is shaped like a "T" with the vertical stroke of the T being, at one end, swivellably connected to the rope, and also being, at the other end, connected to the crosspiece, a.k.a. transverse portion, of the T. The handle may be held with the crosspiece of the T situated between fingers and palm and with the vertical "stroke", a.k.a. elongate portion, extending between two fingers. The crosspiece a.k.a. transverse portion of the handle is asymmetric, and thereby adapted to fit to a hand which is holding the handle with the vertical a.k.a. elongate portion passing between two fingers other than the second (index) and third (middle) fingers. This gives a more comfortable and effective skipping position, which allows the transverse portion of the handle to be in contact with all the fingers and/or the full width of the palm.

6 Claims, 10 Drawing Sheets

SKIPPING ROPE HAVING IMPROVED HANDLE

CROSS REFERENCE TO RELATED APPLICATION

The present application is a Continuation of U.S. Ser. No. 10/673,936, filed Sep. 29, 2003 which is a Continuation-in-Part of U.S. Ser. No. 10/409,687, filed Apr. 7, 2003 that is a continuation of U.S. Ser. No. 09/774,376 filed Jan. 31, 2001 and issued as U.S. Pat. No. 6,544,149.

APPENDIX

This application does not include a computer program appendix.

STATEMENT REGARDING FEDERALLY SPONSORED RESEARCH

Not applicable.

TECHNICAL FIELD

This invention relates to skipping ropes in general, and in particular to an improved skipping rope handle.

BACKGROUND OF THE INVENTION

Skipping or jumping ropes have been known for centuries and constitute both a children's activity plaything and a serious device for promoting health and fitness. The exercise of "skipping" (also known as "jumping rope") is one which can have substantial beneficial effects. It is particularly practiced by boxers in order to build up muscle strength and tone as well as sharpening reactions.

Conventional skipping ropes consist of a length of flexible material such as rope or a plastics substitute for rope with a handle at each end.

Generally speaking, the handle is an elongate member which, if held up by the rope, extends vertically. While not absolutely necessary, most skipping ropes enable the rope to swivel about the elongate axis of the handle in order that, as the loop of rope is turned around the body of the person skipping during that activity, it does not undergo twisting.

The conventional disposition of handles and swivel mechanisms is not ideal, particularly for serious skipping, for a number of reasons:

First the holding position of the handles is somewhat awkward; with the handles held extending across the palm of the hand, and held against that by the curled fingers and the thumb, in order to position the handle horizontally and with the end from which the rope extends remote from the skippers body, the arms must be turned outwards around their longitudinal axis, i.e. each hand must be supinated, in anatomical terms, such that the thumb is turned away from the body This is not particularly comfortable, compared with the relaxed position of the hands when the arms are simply allowed to hang at a person's sides, where the palms face inwards. This relaxed position, or "rest" position is, in anatomical terms, between the pronated position and supinated position. The rest position is characterized by the palms of each hand each facing inwards towards the body, with the thumbs being on the front side of the body.

Secondly, the swivel mechanism introduces friction and drag which, at high skipping speeds, can be substantial.

Also, at high skipping speeds it is easy for the handle to slip axially within the hand, or even, due to the high pull from the rotating rope, slip out from the hand entirely. If slippage is compensated by the skipper attempting to shift the handle inwards, this can easily lead to the handle being moved so far in that the rotating rope then starts to chafe at the knuckles of the thumb and first finger, which is naturally undesirable. Minimizing or preventing slippage with such a handle is not easy, and often requires the user to clench the grip more tightly.

An approach to address these concerns about conventional skipping ropes is disclosed in U.S. patent application Ser. No. 09/774,376, filed 31 Jan. 2001, which discloses a skipping rope characterized by having a handle at each end which consists of an elongate portion attached to one end of the rope and a portion transverse thereto at its outer end. This provides a type of "T-bar" handle, with much improved grip.

When using such a skipping rope, the transverse portion can be held easily effectively in the palm of the hand with the elongate portion extending between two fingers. This gives a much more comfortable skipping position as well as a considerably more slip-proof one, even if the hand becomes sweaty. The transverse portion of the handle nestles within the curled up fingers (which are naturally characteristic of the hand at rest) while the elongate portion extends between two of the fingers. When held in the center of the hand, the elongate portion would pass between the second (middle) and third (ring) fingers. The effective grip, e.g. the ability to retain the handle and to resist the rope attempting to escape the users grip is much stronger, and the distribution of forces is better configured with the base of the fingers taking the strain rather than the forefinger and thumb doing so (as is the case in an ordinary handle which must be firmly gripped by the thumb and forefinger); thus, clenching is not needed, in contrast to the clenching often needed by the user of a conventional handle. This can be of particular importance if the skipper does not have a strong grip, for example due to arthritis, injury or even deformity in the hand or hands. The position is much more secure, being more in the nature of a mechanical interlock than a friction grip. The hands are also held at the sides without twisting the arms, i.e. with the backs (a.k.a. dorsal sides) of the hands facing outwards on opposite sides of the skipper's body; in anatomical terms, it may be said that the hands are held at the sides without requiring supination of the wrist, hand, or arm.

As mentioned above, and as particularly noticed in and disclosed in the aforementioned application Ser. No. 09/774,376, from which the present application is a continuation-in-part, it was found desirable for the elongate portion to extend between two of the fingers, and the transverse portion of the handle to be symmetric with respect to the position of the elongate portion. While such a configuration has many advantages, particularly (but not exclusively) when it is held so that the elongate portion passes between the second (middle) and third (ring) fingers, when the handle is held such that the elongate portion passes between the first (a.k.a. index) and second (a.k.a. middle) fingers the transverse portion is substantially, if not completely, in contact only with the index and middle fingers. Moreover, if that same handle is held such that the elongate portion passes between the third (a.k.a. ring) finger and fourth (a.k.a. little) finger, the transverse portion is substantially, if not completely, in contact only with the ring finger and the little finger. Thus, when the elongate portion of the handle is between the ring and little finger, or between the index finger and middle finger, the user of the handle disclosed in the parent application does not feel the transverse portion across all the fingers of his hand and may subjectively experience this as an uncomfortable feeling and/or a less-than-optimal grip; such a user may prefer feeling a handle with the transverse portion sized so as to be felt across all the fingers of his or her hand. (It should be understood that, with the handle of the above-cited parent application, such a feeling may be provided, if at all, only when the elongate portion is held between the second (middle) and third (ring) fingers of the hand.)

BRIEF SUMMARY OF THE INVENTION

In accordance with the present invention, there is disclosed a handle for a rope which is an improvement upon the design of the preferred embodiment of the above-referenced parent application (in which the transverse portion of the handle was seen to be symmetric.) More specifically, in accordance with the present invention, the transverse portion of the handle is not symmetric, and is in fact asymmetric, having two sub-portions of unequal length, such that, when the handle is held such that the elongate portion passes between the index finger and the middle finger, the sub-portions of the transverse portion are appropriately sized so as to be in contact, not with only the index finger and middle finger, but with the index finger and the middle finger, ring finger, and lime finger. Similarly, when the handle is held such that the elongate portion passes between the ring finger and the little finger, the sub-portions of the transverse portion are appropriately sized so as to be in contact, not with only the little finger and the ring finger, but to be in contact with the little finger, and the ring finger, middle finger, and index finger. Thus, the improved handle of the present application, e.g. a handle having a transverse portion which is asymmetric in relation to the elongate portion to which it is joined, is seen to be particularly suited for holding the handle such that the elongate portion passes between the fingers other than the middle finger and ring finger. The rope Is preferably attached to the handle by means of a swivel. This is preferably a low friction swivel, for example a small ball-bearing or the like, but many types of simple mechanical joint construction may be used. One possibility is to have the end of the rope pass through a bore in a ball, the end being knotted and the knot located in a counterbore to prevent it protruding from the outline of the ball. The ball may then be received in a cup internally coated with low-friction material mounted on the end of the elongate part of the handle remote from the transverse part. The ball may be held captive in the cup by suitable means, and may also be constrained to rotate within the cup in such a fashion that the axis of the rope lies within a certain solid angular range relative to the axis of the elongate portion of the handle. In an alternative construction, the end of the rope may be arranged to extend substantially transversely to the axis of the elongate portion of the handle. For example, the rope may be fixed at each end to a swivel collar which, via a suitable low friction bearing, is mounted on the end of the handle remote from the transverse portion.

In a further alternative, the rope end may have a suitable tab or collet attached thereto and the end of the elongate portion may have a socket into which the tab or collet may be fitted in a way enabling its free rotation about the axis of the rope, but not enabling it to be extracted axially from the elongate portion of the handle.

The handles may be made of any convenient material or assembly of materials. The handle may be a unitary plastics molding.

A skipping rope in accordance with the invention is illustrated by way of example in the accompanying diagrammatic drawings.

DETAILED DESCRIPTION OF THE PRESENTLY PREFERRED EMBODIMENT

Figure 1:
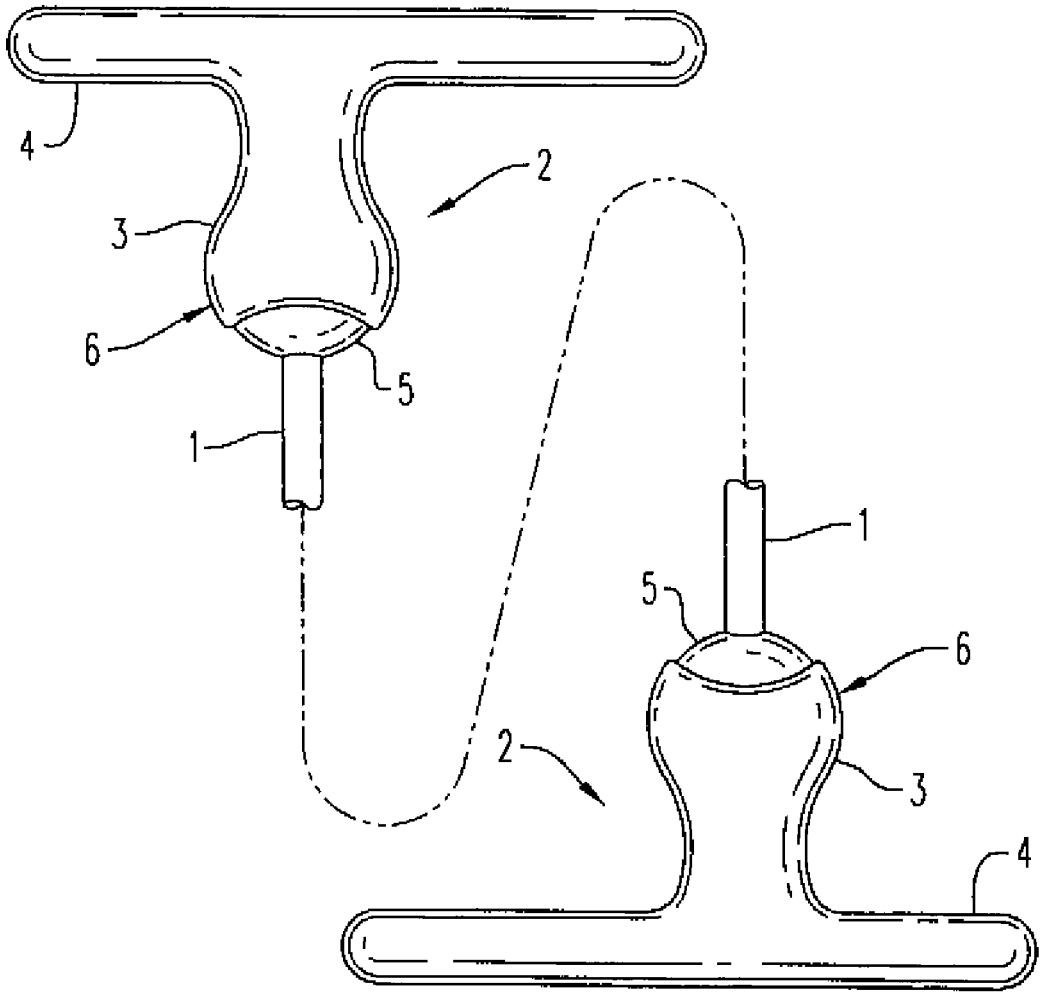
FIG. 1 is a side view of a skipping rope having at each end an improved, asymmetric handle in accordance with the present invention, with the majority of the rope (indicated by a dotted line) omitted for clarity.

Reference is now made to FIG. 1, wherein a rope 1 has on each end a handle 2. Each handle consists of an elongate portion 3 which is adapted to be placed between the fingers with a transverse portion 4 then resting inside the hand of the skipper. The ends of the rope are attached to a rotatable ball 5 which is set in a cup at the end of portion 3. The materials of the ball and the cup are chosen to enable the ball to rotate with low friction. The end of rope 1 passes through a relatively close-fitting bore in ball 5 and may be held captive in the ball by any one of a number of suitable means, e.g. by a knot or other enlarged end portion which is located in an enlarged counterbore (not shown for clarity) in ball 5. The dimensions of ball 5 and the cup on the end of portion 3 are such that the ball may be press-fitted into place using a force sufficient to enable that to occur, but without damage to the cup, the force to pull the rope 1 and ball 5 out of the cup being sufficiently high to ensure that the ball remains captive even at high skipping speeds. The length of portion 3 is sufficient to hold the rope sufficiently far away from the back of the users hand to avoid risk of the rope rubbing or chafing the user's hand.

Figure 2:
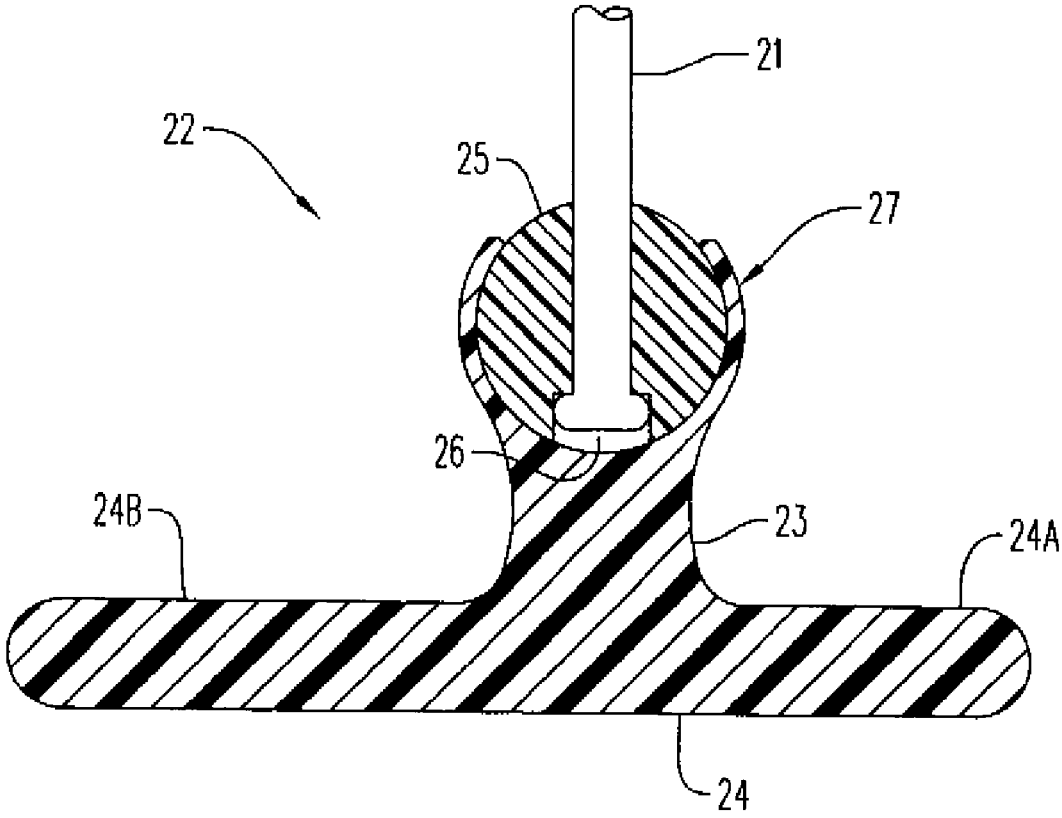
FIG. 2 is a longitudinal section through one of the handles shown in FIG. 1, showing a first embodiment of a handle.

Reference is now made to FIG. 2, wherein a rope 21 has on each end a handle 22. Each handle consists of an elongate portion 23 which is adapted to be placed between the fingers with a transverse portion 24 then resting inside the hand of the skipper. Note that transverse portion 24 has sub-portions 24A and 24B, said sub-portions 24A and 24B being sized i.e. by dimensioning a sub-portion of the transverse portion such that, when the handle is held such that the elongate portion passes between the first and second fingers, said sub-portion of the transverse portion is long enough to be in contact not only with the first (a.k.a. index) finger and second (a.k.a. middle) finger, but with the index finger and the middle, third (a.k.a. ring), and the fourth (a.k.a. little) fingers. Similarly, when the handle is held such that the elongate portion passes between the little finger and the ring finger, said sub-portion is long enough to be in contact not only with little finger and the ring finger, but with little finger and the ring, middle, and index fingers. The ends of the rope are attached to a rotatable ball 25 which is set in a cup at the end of portion 23. The materials of the ball and the cup are chosen to enable the ball to rotate with low friction. The end of rope 21 passes through a relatively dose-fitting bore in ball 25 and is held captive in the ball by a knot or other enlarged end portion which is located in an enlarged counterbore 26 in ball 25. The dimensions of ball 25 and the cup on the end of portion 23 are such that the ball may be press-fitted into place using a force sufficient to enable that to occur, but without damage to the cup, the force to pull the rope 21 and ball 25 out of the cup being sufficiently high to ensure that the ball remains captive even at high skipping speeds. The length of portion 23 is sufficient to hold the rope sufficiently far away from the back of the user's hand to avoid risk of the rope robbing or chafing the users hand.

Figure 3:
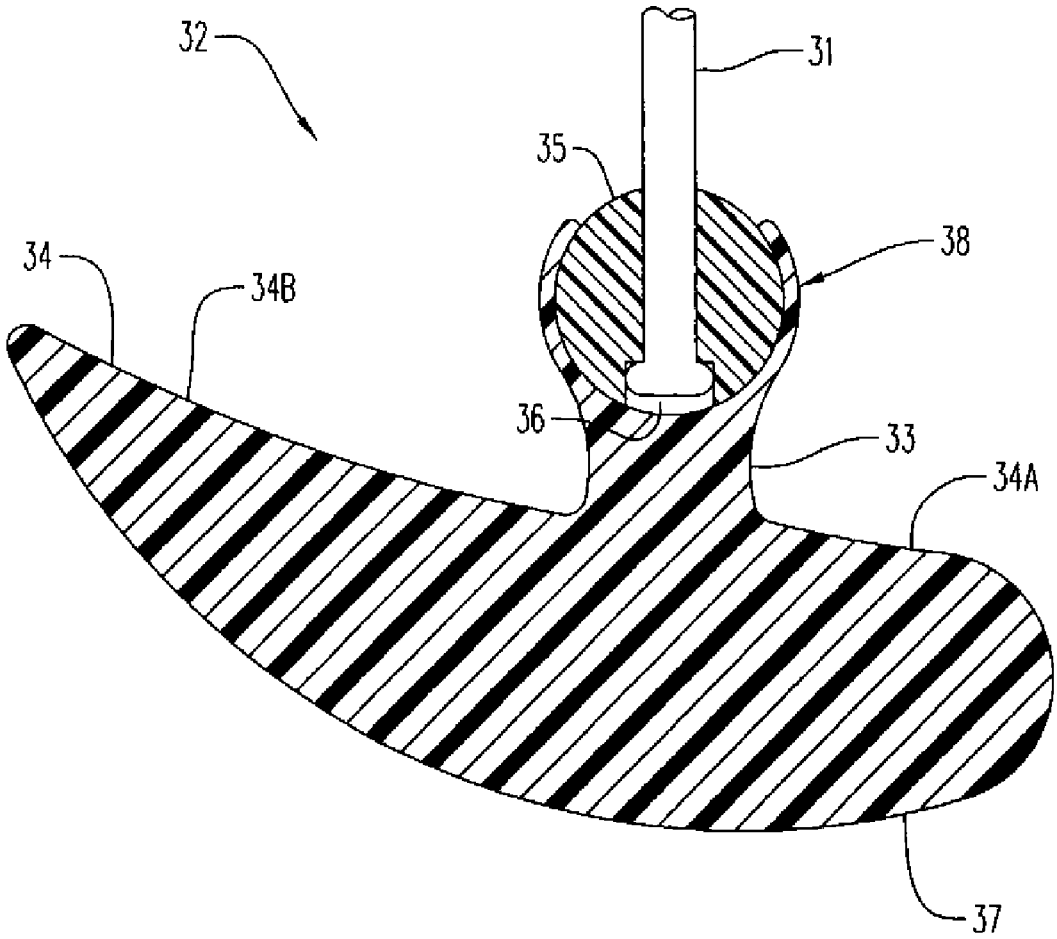
FIG. 3 is a longitudinal section through one of the handles shown in FIG. 1, showing a second embodiment of a handle.

Reference is now made to FIG. 3, wherein a rope 31 has on each end a handle 32. Each handle consists of an elongate portion 33 which is adapted to be placed between the fingers with a transverse portion 34 then resting inside the hand of the skipper. Note that transverse portion 34 is of a teardrop shape, and, similar to the handle shown in connection with, e.g. FIG. 2, has portions 34A and 34B, said portions 34A and 34B being sized to enable grasping of the handle with portion 33 being disposed between two fingers other than the middle and ring fingers and with the teardrop shape of transverse portion 34 conforming comfortably to the palm, and in particular having surface 37 which is especially adapted to fit the palm. The ends of the rope are attached to a rotatable ball 35 which is set in a cup at the end of portion 33. The materials of the ball and the cup are chosen to enable the ball to rotate with low friction. The end of rope 31 passes through a relatively close-fitting bore in ball 35 and is held captive in the ball by a knot or other enlarged end portion which is located in an enlarged counterbore 36 in ball 35. The dimensions of ball 35 and the cup on the end of portion 33 are such that the ball may be press-fitted into place using a force sufficient to enable that to occur, but without damage to the cup, the force to pull the rope 31 and ball 35 out of the cup being sufficiently high to ensure that the ball remains captive even at high skipping speeds. The length of portion 33 is sufficient to hold the rope sufficiently far away from the back of the users hand to avoid risk of the rope rubbing or chafing the user's hand.

Figure 4:
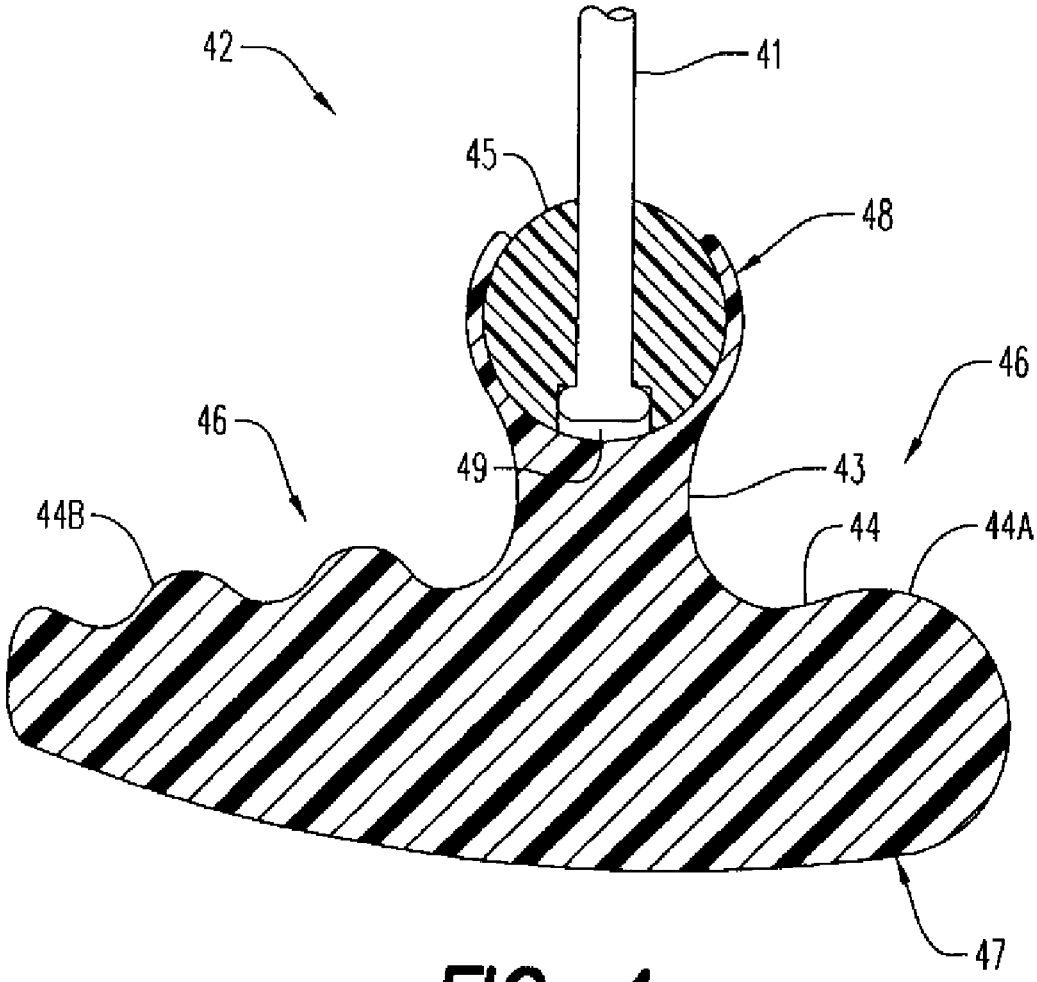
FIG. 4 is a longitudinal section through one of the handles shown in FIG. 1, showing a third embodiment of a handle

Reference is now made to FIG. 4, wherein a rope 41 has on each end a handle 42. Each handle consists of an elongate portion 43 which is adapted to be placed between the fingers with a transverse portion 44 then resting inside the hand of the skipper. Note that transverse portion 44 has a side which has arcuate depressions in a pattern resembling waves, and, similar to the handle shown in connection with, e.g. FIG. 2, also has portions 44A and 44B, said portions 44A and 44B being sized to enable grasping of the handle with portion 43 being disposed between two fingers other than the middle two fingers and with the waveshaped surface of transverse portion 44 accommodating the fingers of the user and with the other side of transverse portion 34 conforming comfortably to the palm, and in particular having surface 47 which Is especially adapted to fit the palm. The ends of the rope are attached to a rotatable ball 45 which is set in a cup at the end of portion 43. The materials of the ball and the cup are chosen to enable the ball to rotate with low friction. The end of rope 41 passes through a relatively close-fitting bore in ball 45 and is held captive in the ball by a knot or other enlarged end portion which is located in an enlarged counterbore 46 in ball 45. The dimensions of ball 45 and the cup on the end of portion 43 are such that the ball may be press-fitted into place using a force sufficient to enable that to occur, but without damage to the cup, the force to pull the rope 41 and ball 45 out of the cup being sufficiently high to ensure that the ball remains captive even at high skipping speeds. The length of portion 43 is sufficient to hold the rope sufficiently far away from the back of the user's hand to avoid risk of the rope rubbing or chafing the user's hand.

Figure 5A:
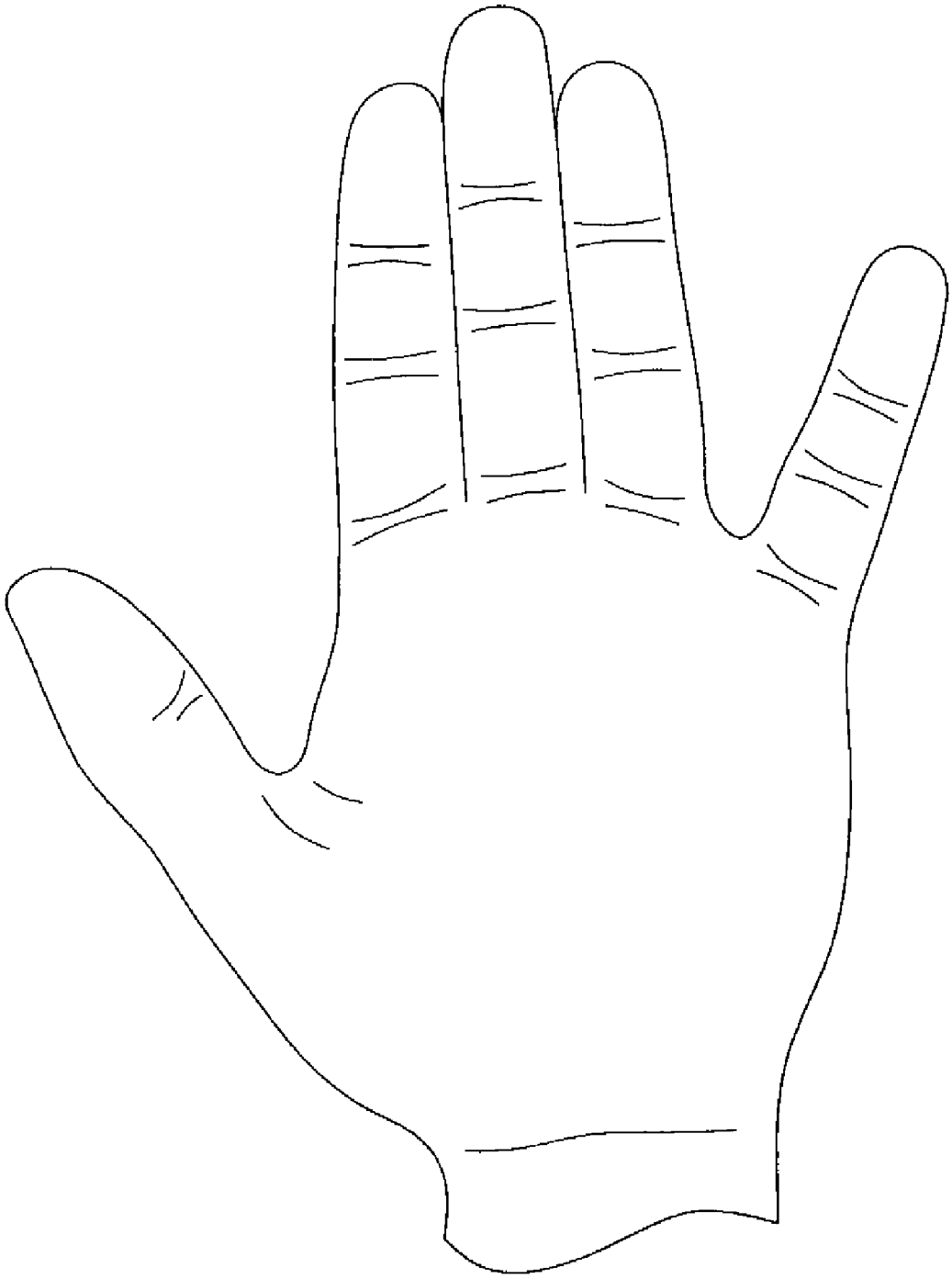
FIG. 5A is a plan view of the palm (ventral) side of a hand, shown with the ring finger and little finger moved apart from one another so as to accommodate said elongate member therebetween.
Figure 5B:
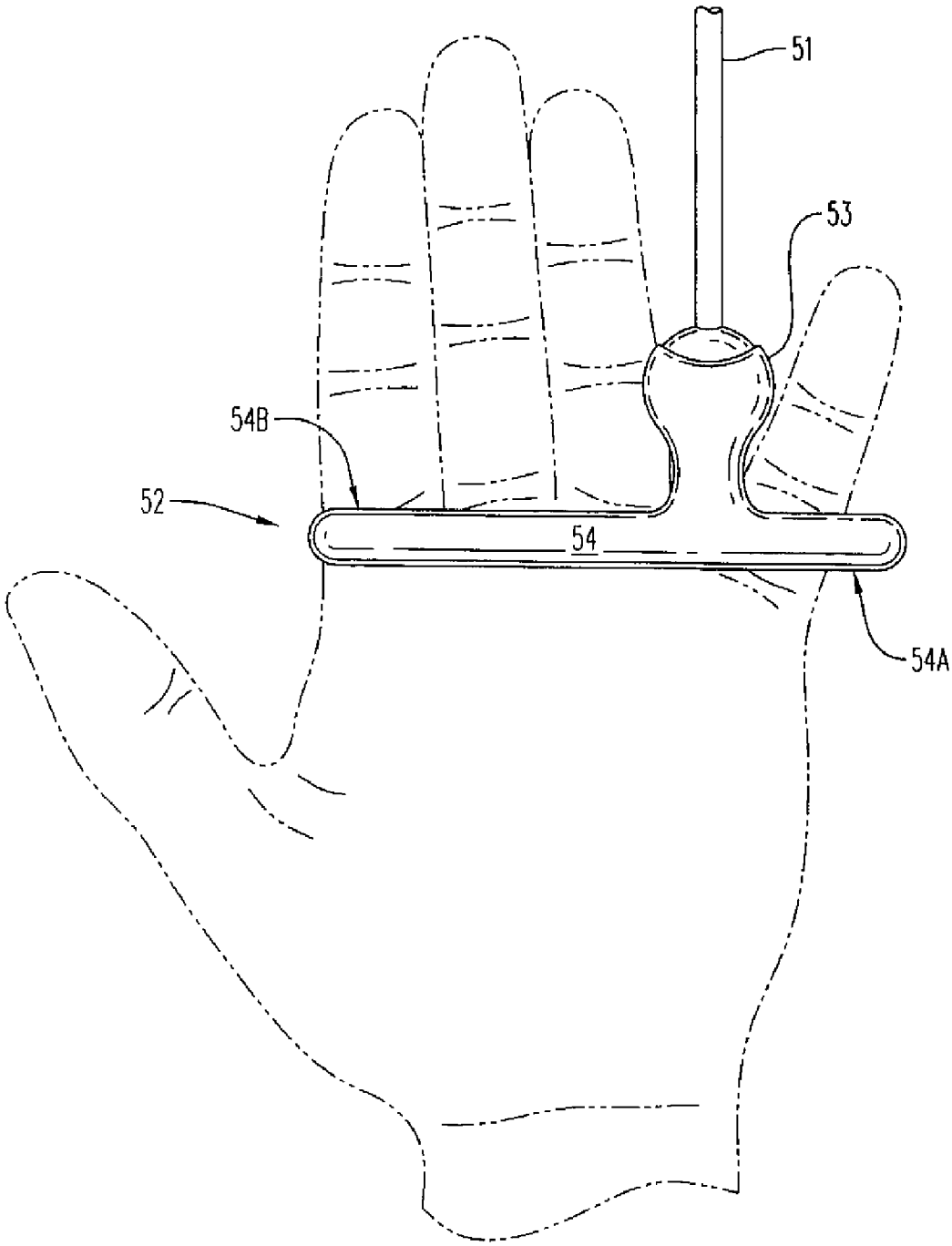
FIG. 5B is a view showing a handle of a rope according to the present invention laid in the open palm depicted in FIG. 5A.
Figure 5C:
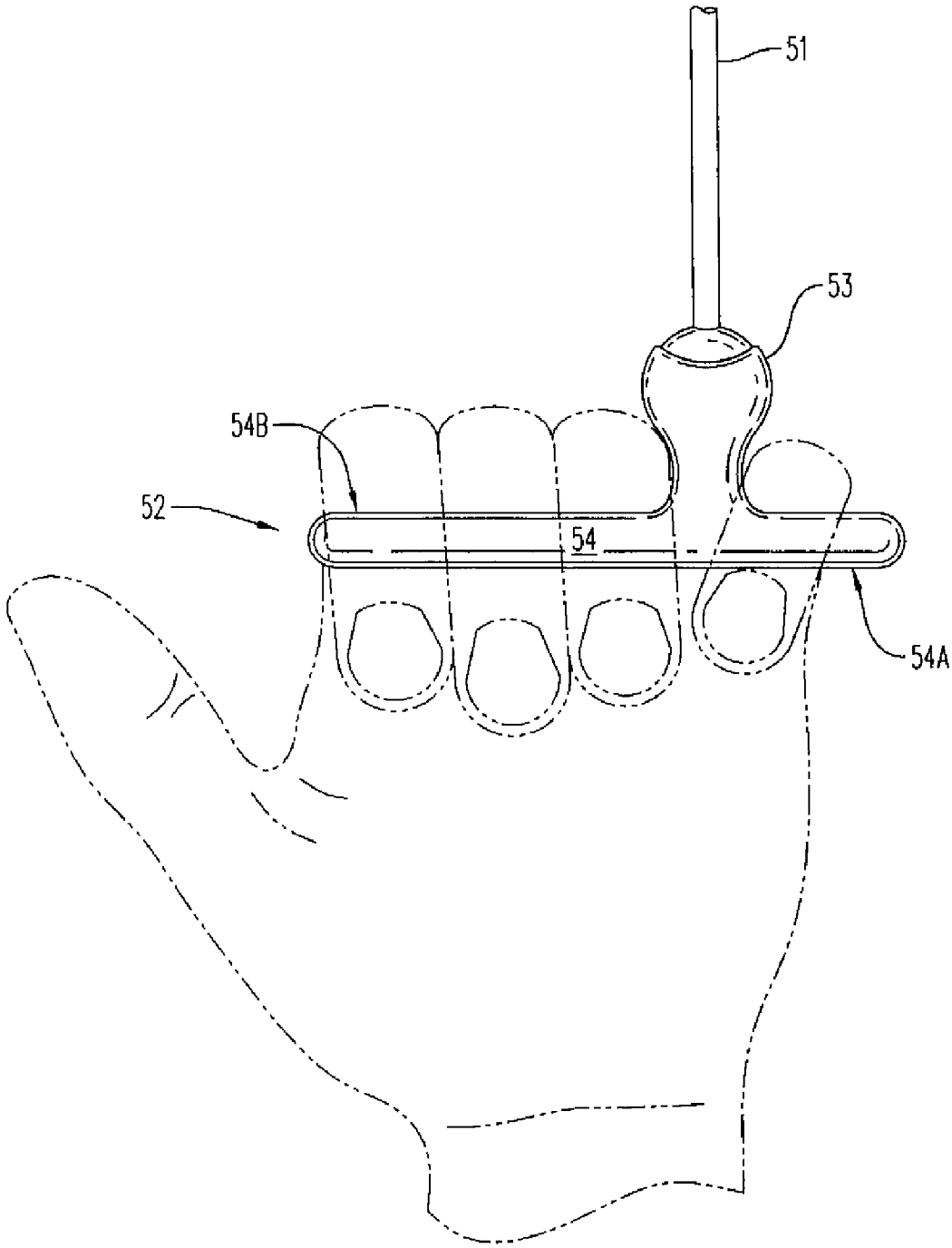
FIG. 5C is a view showing a handle of a rope according to the present invention now held in the hand which was depicted in the open position in FIG. 5A and FIG. 5B, but which is now in the closed position.

Reference is now made to FIG. 5A, which depicts the palm (ventral) side of a hand, shown with the ring finger and little finger moved apart from on another so as to accommodate said elongate member therebetween. Reference is now made to FIG. 5B, which is a view showing the view showing a handle of a rope according to the present invention laid in the open palm depicted in FIG. 5A which depicts rope 51 having on its end a handle 52. Each handle consists of an elongate portion 53 which is adapted to be placed between the fingers with a transverse portion 54 then resting inside the hand of the skipper. Reference is now made to FIG. 5C; note that transverse portion 54 has sub-portions 54A and 54B, said sub portions 54A and 54B being sized asymmetrically such that, when the handle is held such that the elongate portion passes between the lithe finger and the ring finger, said transverse portion is sized so that one sub-portion is sized to be in contact with the little finger and the ring finger, and the other sub-portion is sized so as to be in contact with the ring, middle, and index fingers. To demonstrate an alternative embodiment, the ends of the rope here are not shown attached to a rotatable ball 55 which is set in a cup at the end of portion 53; in such a case, the materials of the ball and the cup would be chosen to enable the ball to rotate with low friction. Instead the end of rope 51 here is shown simply connected to the elongate portion 53. The length of elongate portion 53 is sufficient to hold the rope sufficiently far away from the back of the user's hand to avoid risk of the rope rubbing or chafing the user's hand.

Figure 6A:
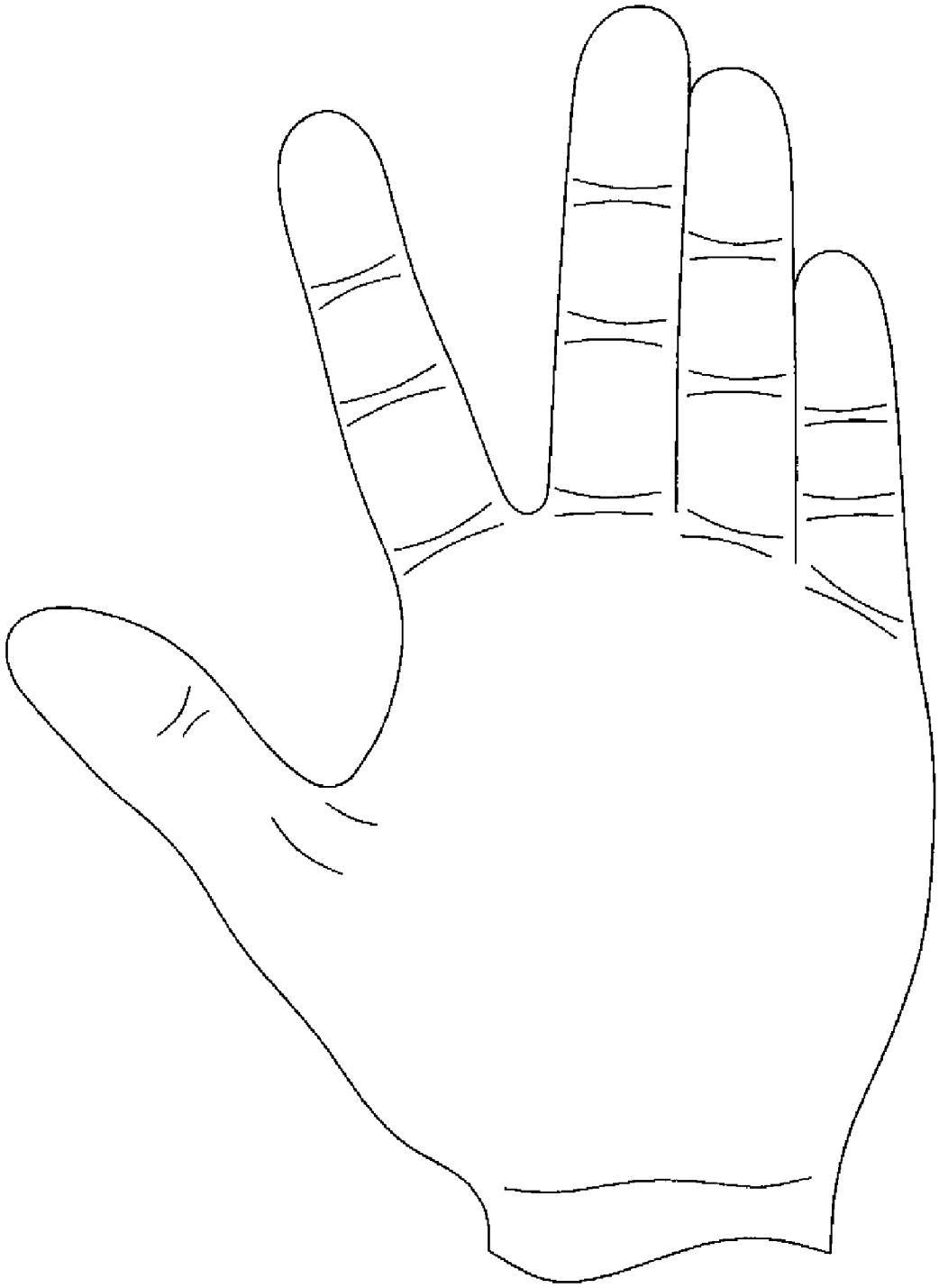
FIG. 6A is a plan view of the palm (ventral) side of a hand, shown with the index finger and middle finger moved apart from one another so as to accommodate said elongate member therebetween.
Figure 6B:
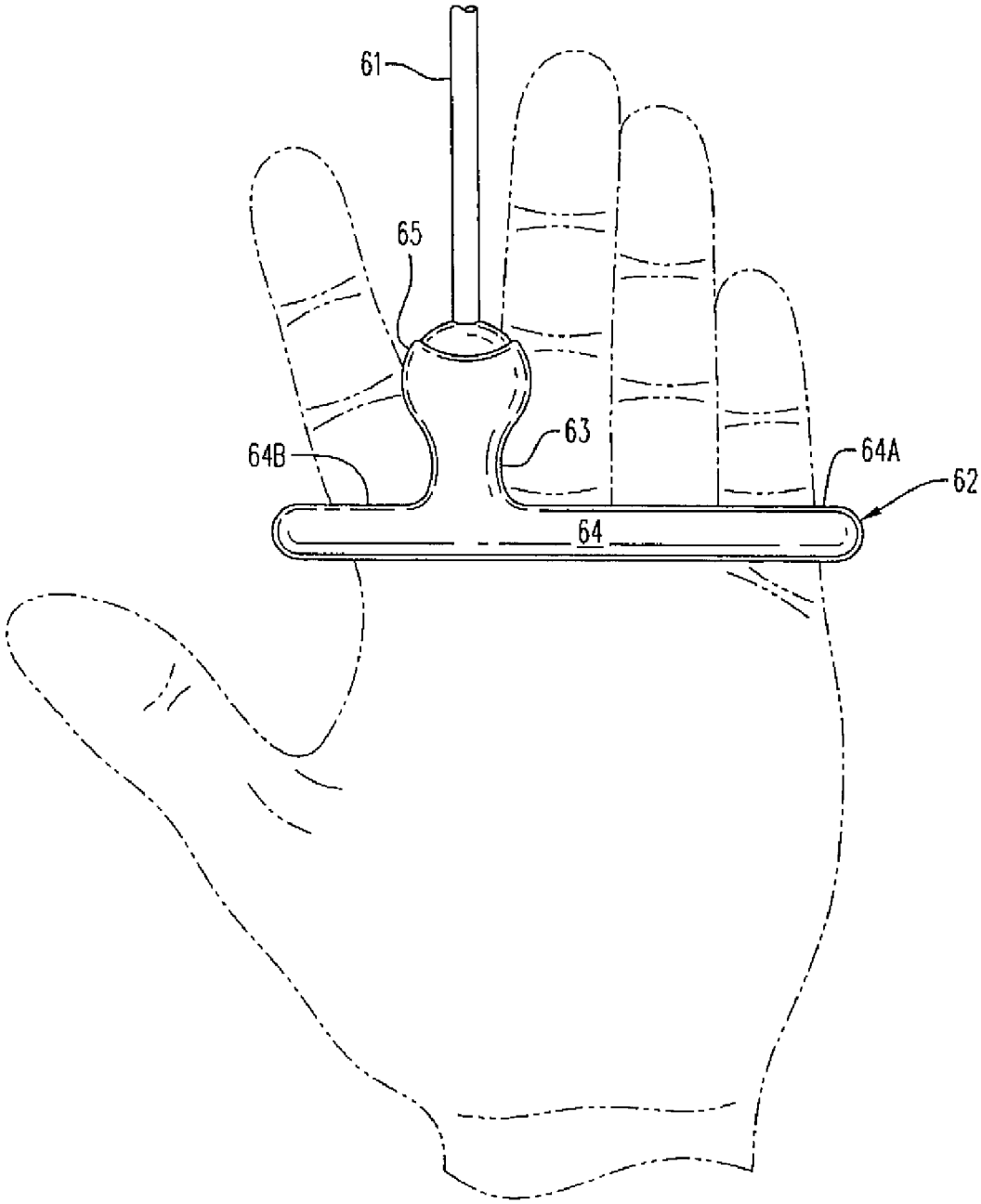
FIG. 6B is a view showing a handle of a rope according to the present invention laid in the open palm depicted in FIG. 6A.
Figure 6C:
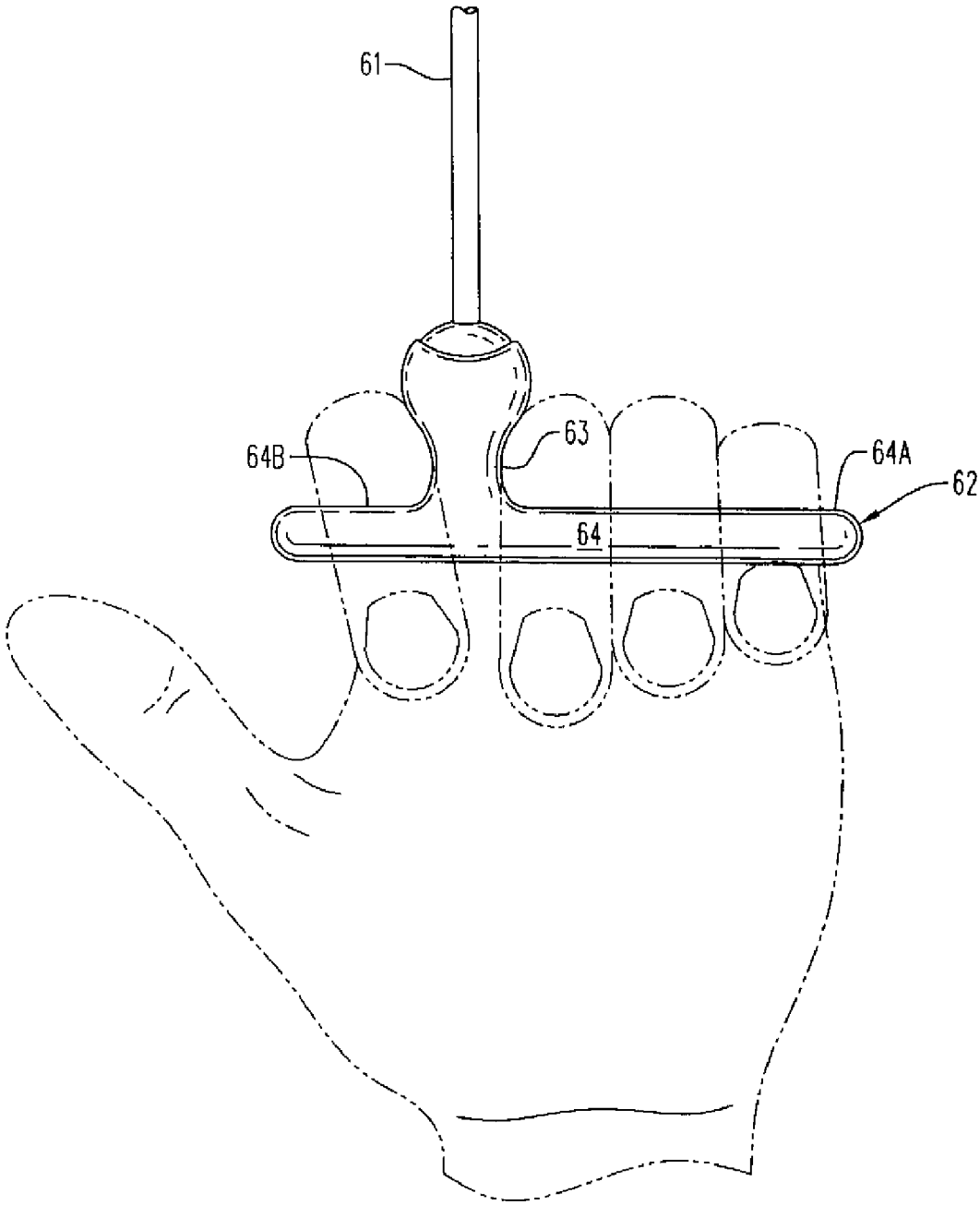
FIG. 6C is a view showing the handle of a rope according to the present invention now held in the hand which was depicted in the open position in FIGS. 6A and 6B, but which is now in the closed position.

Reference is now made to FIG. 6A, which is a plan view of the palm (ventral) side of a hand, shown with the index finger and middle finger moved apart from one another so as to accommodate said elongate member therebetween. Reference is now made to FIG. 6B, which is a view showing the handle of a rope according to the present invention laid in the open palm depicted in FIG. 6A which depicts rope 61 having on its end a handle 62. Each handle consists of an elongate portion 63 which is adapted to be placed between the fingers with a transverse portion 64 then resting inside the hand of the skipper. Reference is now made to FIG. 6C; note that transverse portion 64 has sub-portions 64A and 64B, said sub-portions 64A and 64B being sized asymmetrically such that, when the handle is held such that the elongate portion passes between the little finger and the ring finger, said transverse portion is sized so that one sub-portion is sized to be in contact with the little finger and the ring finger, and the other sub-portion is sized so as to be in contact with the ring, middle, and index fingers. To demonstrate an alternative embodiment, the ends of the rope here are not shown attached to a rotatable ball 65 which is set in a cup at the end of portion 63; in such a case, the materials of the ball and the cup would be chosen to enable the ball to rotate with low friction. Instead, the end of rope 61 here is shown simply connected to the elongate portion 63.

The length of elongate portion 63 is sufficient to hold the rope sufficiently far away from the back of the user's hand to avoid risk of the rope rubbing or chafing the user's hand.

The invention claimed is:

1. A skipping rope comprising:

a length of rope including flexible material; and a pair of handles, each handle including an elongate portion having a first end rotatably attached to an end of the flexible material and a second end connected to a portion transverse to the elongate portion, the first end of the elongate portion attached to the end of the flexible material being larger than the second end of the elongate member connected to the portion transverse to the elongate portion and the portion transverse to the elongate portion being a teardrop shape and having two sub-portions, one sub-portion having a tapered end being of greater extent than the other sub-portion having a larger rounded end.

2. The skipping rope of claim 1, wherein the first end of the elongate portion attached to the end of the flexible material has a larger outer circumference than the second end of the elongate member connected to the portion transverse to the elongate portion.

3. The skipping rope of claim 1, wherein the second end of the elongate member connected to the portion transverse to the elongate portion is substantially cylindrical shaped.

4. The skipping rope of claim 1, wherein the first end of the elongate portion attached to the end of the flexible material is substantially round-shaped.

5. The skipping rope of claim 4, wherein the flexible material is attached to the elongate portion of each handle via a swiveling ball through which the end of the flexible material passes.

6. The skipping rope of claim 5, wherein the elongate portion of each handle comprises a cup for receiving the ball and means to retain the ball within the cup.

* * * * *